US005672088A

United States Patent [19]

Chininis

[11] Patent Number: 5,672,088

[45] Date of Patent: Sep. 30, 1997

[54] INFANT TOY WITH UNIVERSAL MOUNTING MEANS

[75] Inventor: Stephen P. Chininis, Norcross, Ga.

[73] Assignee: Kids II, Inc., Alpharetta, Ga.

[21] Appl. No.: 389,594

[22] Filed: Feb. 16, 1995

[51] Int. Cl.[6] ..... A63H 33/00; A47D 15/00; A47B 96/00

[52] U.S. Cl. ..... 446/227; 248/229.15; 248/231.71; 40/617

[58] Field of Search ..... 446/227; 248/229.15, 248/228.6, 231.41, 231.71, 223.41, 103, 126; 24/525, 522, 569, 514, 662, 297; 40/617; 5/658, 543.1

[56] References Cited

U.S. PATENT DOCUMENTS

| | | | |
|---|---|---|---|
| 2,711,872 | 6/1955 | Lampke | 248/229.15 X |
| 4,169,575 | 10/1979 | Stefano | 248/231.71 X |
| 4,195,860 | 4/1980 | Berry | 248/229.15 X |
| 4,573,654 | 3/1986 | Nottingham | 446/227 X |
| 5,322,253 | 6/1994 | Stevens | 248/229.15 X |
| 5,370,570 | 12/1994 | Harris | 446/227 |

*Primary Examiner*—Mickey Yu
*Attorney, Agent, or Firm*—Beveridge, DeGrandi, Weilacher & Young, L.L.P.

[57] ABSTRACT

An infant mobile or other toy has a main housing which is attached to a crib, travel bed, changing table or other article of infant's furniture. For use with a furniture piece such as a crib with slatted sides, a screw on a pressure knob is threaded into the housing to clamp the slats are clamped between the pressure knob and a vertical clamping surface on the housing. For other furniture items such as travel beds and changing tables which have configurations unsuitable for use with such a pressure knob, a clamping assembly is used. The clamping assembly has a base which is removably attached to the housing, a bracket mounted on the base, and a screw threaded to an arm of the bracket. By rotating the screw, a part of the furniture piece can be clamped between a pressure pad on the screw and a vertical clamping surface on the base. To position the mobile over an infant when the base is attached at or near a corner of the furniture piece, the base is wedge shaped. The vertical clamping surface of the removable base is at an acute horizontal angle to the vertical clamping surface of the main housing, thus skewing the main housing. The inclination of the bracket arm can be changed and locked to provide lateral adjustments in the position of the pressure pad.

28 Claims, 5 Drawing Sheets

36
40
44
38
8
10
22
24
30
26
28
34
32
74
47
46
48
72
56
55
68
58
52
54
53
50
76
94

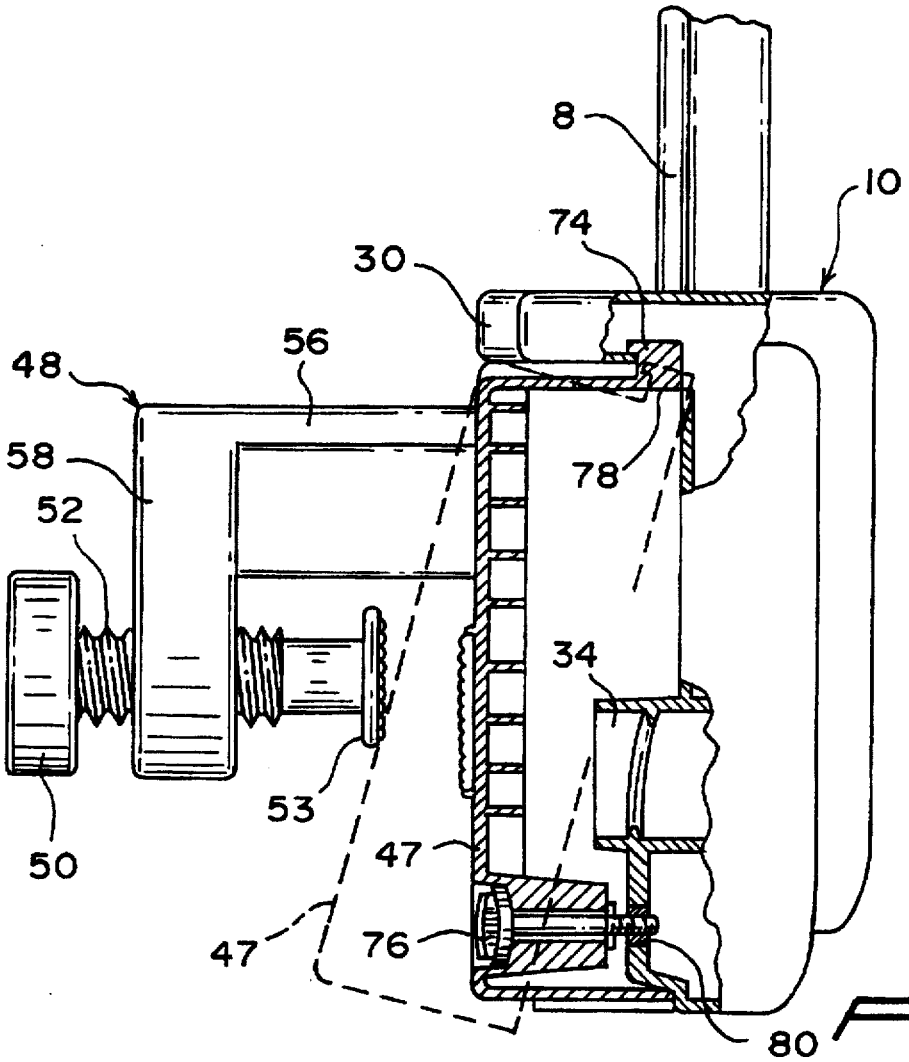
FIG. 7
FIG. 8
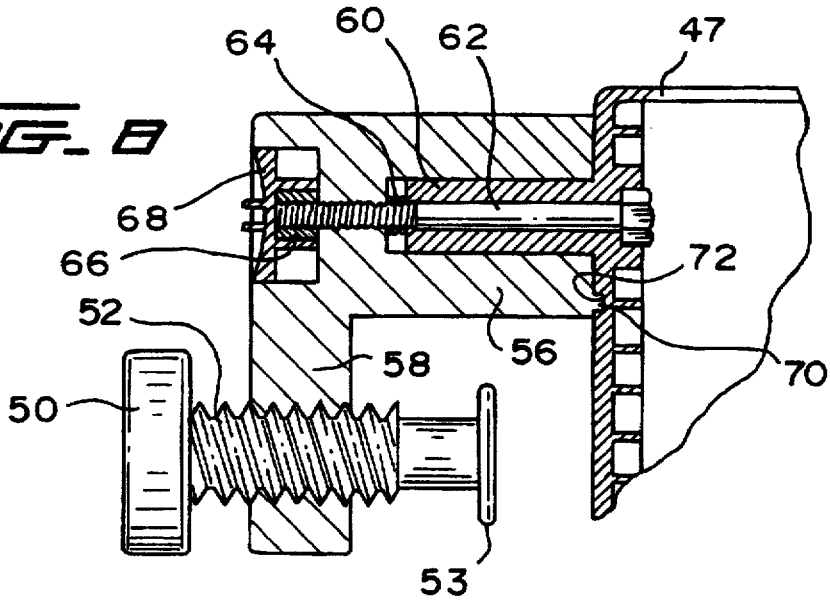

INFANT TOY WITH UNIVERSAL MOUNTING MEANS

BACKGROUND OF THE INVENTION

Many mobiles and other infant toys are designed for attachment to infant furniture pieces, particularly cribs. Currently on the market there are mobiles in which a housing is clamped to the side of a crib by a pressure knob which bears against adjacent vertical slats of the side of the crib. A support arm is cantilevered from the housing and has a small upper housing at its upper end. An electric motor in the upper housing is connected by an electrical circuit to batteries in the lower housing. The motor rotates an eye which, in turn, supports cross arms and mobile figures. A music box inside the lower housing provides audible accompaniment to the rotating motion of the cross arms and mobile figures.

The pressure knob structure described above is suitable when the mobile is attached to a conventional crib, but it is unsuitable for other types of infant furniture such as travel beds, changing tables, and the like. Thus, there is a need in the art for an arrangement whereby a mobile or other infant's toy can be mounted on many different pieces of infant furniture. This need is satisfied by the present invention.

In the past, some lightweight mobiles were mounted on infant furniture pieces by a bracket which had an inverted U-shaped configuration. The bracket was positioned so that its two vertical legs were on opposite sides of a part of the infant furniture piece. A thumb screw extended through one of these legs, and it was provided with a pressure pad which exerted pressure on the furniture piece to retain the bracket in position. These devices were small and lightweight. They would have been incapable of supporting the mass of present day motor driven musical mobile assemblies.

SUMMARY OF THE INVENTION

As stated above, this invention provides a toy assembly which is mountable on many different infant furniture pieces such as cribs, travel beds, changing tables, etc.

In one respect, a toy assembly according to the invention includes a housing, a toy (preferably an infant's mobile) attached to and supported by the housing, and a clamping assembly which has a base which is removably mountable on the housing. A mechanism (preferably a screw) is mounted on the base. A pressure pad is operatively connected to and moved by the mechanism to a position where it frictionally engages part of an infant furniture piece to clamp the clamping assembly and its attached housing to the furniture piece. The toy assembly also has a known type of pressure knob which is mountable on the housing in lieu of the clamping assembly. The pressure knob has a pressure surface which faces toward a vertical first clamping surface of the housing. A threaded shaft removably connects the pressure knob to the housing. The threaded shaft extends between the slats of an infant furniture piece, and the pressure surface of the pressure knob bears against the slats to retain the housing in position.

Preferably, the toy is a mobile provided with figures which are observable by an infant lying on a crib, travel bed, changing table or other infant furniture piece. The mechanism is a screw which is rotatable to move the pressure pad. The clamping assembly has a second clamping surface which is vertical. The pressure pad faces toward a clamping surface on the base of the clamping assembly. Thus, part of an infant furniture piece can be clamped between the pressure pad and the clamping surface on the base of the clamping assembly. The clamping surface on the housing is at an acute horizontal angle relative to the second clamping surface on the base, so that the figures of the mobile will be over the area where the infant is lying.

The screw mechanism is preferably mounted on a bracket which includes a post which has one or two flat surface for engaging one or two straight surface of the infant furniture piece. A support arm mounted on the post is movable to and lockable at different inclinations to provide lateral adjustments of the pressure pad. The base has feet for engaging a horizontal surface of an infant furniture piece to stabilize the assembly against lateral tilting. The clamping surface on the base of the removable clamping assembly has an arcuately shaped covering of friction material which resists lateral slipping movement of the toy assembly relative to a surface against which it is clamped.

In another respect, the invention relates to a toy assembly which is mountable on various infant pieces. The assembly includes a housing, a toy, (preferably a mobile) attached to and supported by the housing, and a clamping assembly for supporting the housing. The clamping assembly includes a screw or other mechanism, and a pressure pad which is operatively connected to and moved by the mechanism into frictional clamping engagement with a surface of the furniture piece. According to this aspect of the invention, the mechanism is supported by a support arm which is movable to different inclinations to provide lateral adjustments of the location of the pressure pad. Preferably, means are provided for locking the support arm at a selected inclination.

The invention also relates to a toy assembly which includes a housing, an infant's mobile or another toy attached to and supported by the housing, and a clamping assembly for supporting the housing. The clamping assembly includes a bracket, a screw or mechanism mounted on the bracket, and a pressure pad which is moved by the mechanism into frictional clamping engagement against part of an infant furniture piece. The bracket includes a post and an arm which is supported by the post. The arm is laterally inclined, and the post has two flat surfaces for engaging two straight surfaces of the furniture piece.

Additionally, the invention involves a mobile assembly which has a housing with a vertical surface, a mobile attached to and supported by the housing, and a clamping assembly for clamping the housing onto a furniture piece. The clamping assembly includes a clamping surface, a screw or other mechanism, and a pressure pad which is operatively connected to and moved by the mechanism toward the clamping surface and into frictional clamping engagement against part of the furniture piece. The vertical surface of the housing is skewed at an acute horizontal angle relative to the clamping surface so that, when the housing is mounted in a corner of a furniture piece, the mobile will overlie and be observable by an infant lying on the furniture piece.

BRIEF DESCRIPTION OF THE DRAWINGS

FIG. 7 is a transverse sectional view showing the housing and clamping assembly according to the invention.

FIG. 8 is a sectional view of the bracket, pressure screw and associated components of a clamping assembly constructed according to the invention.

DESCRIPTION OF A PREFERRED EMBODIMENT

Figure 1:
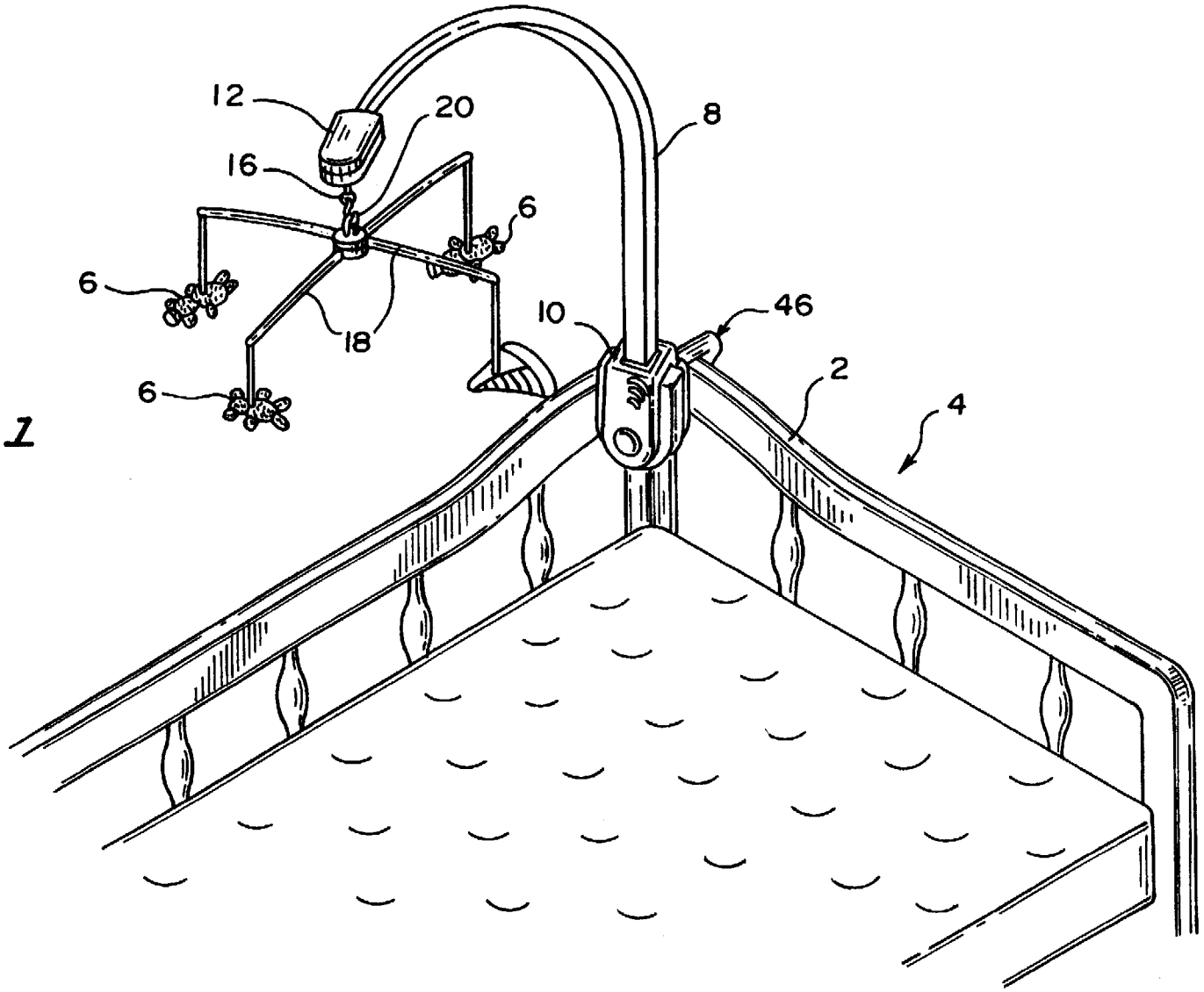
FIG. 1 is a perspective view showing an assembly which includes an infant's mobile constructed according to the invention, mounted on the end of an infant changing table, near the corner thereof.
Figure 6:
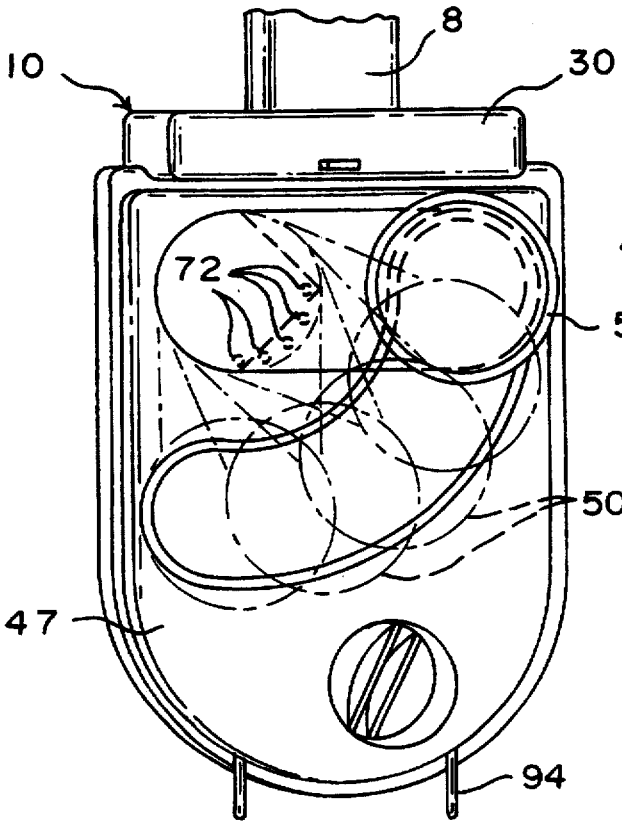
FIG. 6 is a view showing the various positions which can be occupied by the pressure pad of a clamping assembly constructed according to the invention.

FIG. 1 shows a mobile assembly constructed in accordance with the invention, mounted on an infant's changing table 4. The mobile has four FIGS. 6 which are supported by a main support arm 8 which, in turn, is supported by a stationary main housing 10. The main housing 10 is clamped to the end wall 2 of the changing table 4. At the upper end of the arm 8, a motor housing 12 contains an electric motor which rotates an eye 16. The FIGS. 6 are supported by cross arms 18 which are connected to the eye 16 by a hook 20. Electrical conductors extend from a power supply circuit in the main housing 10, through the arm 8, and to the motor in the motor housing 12.

Figure 4:
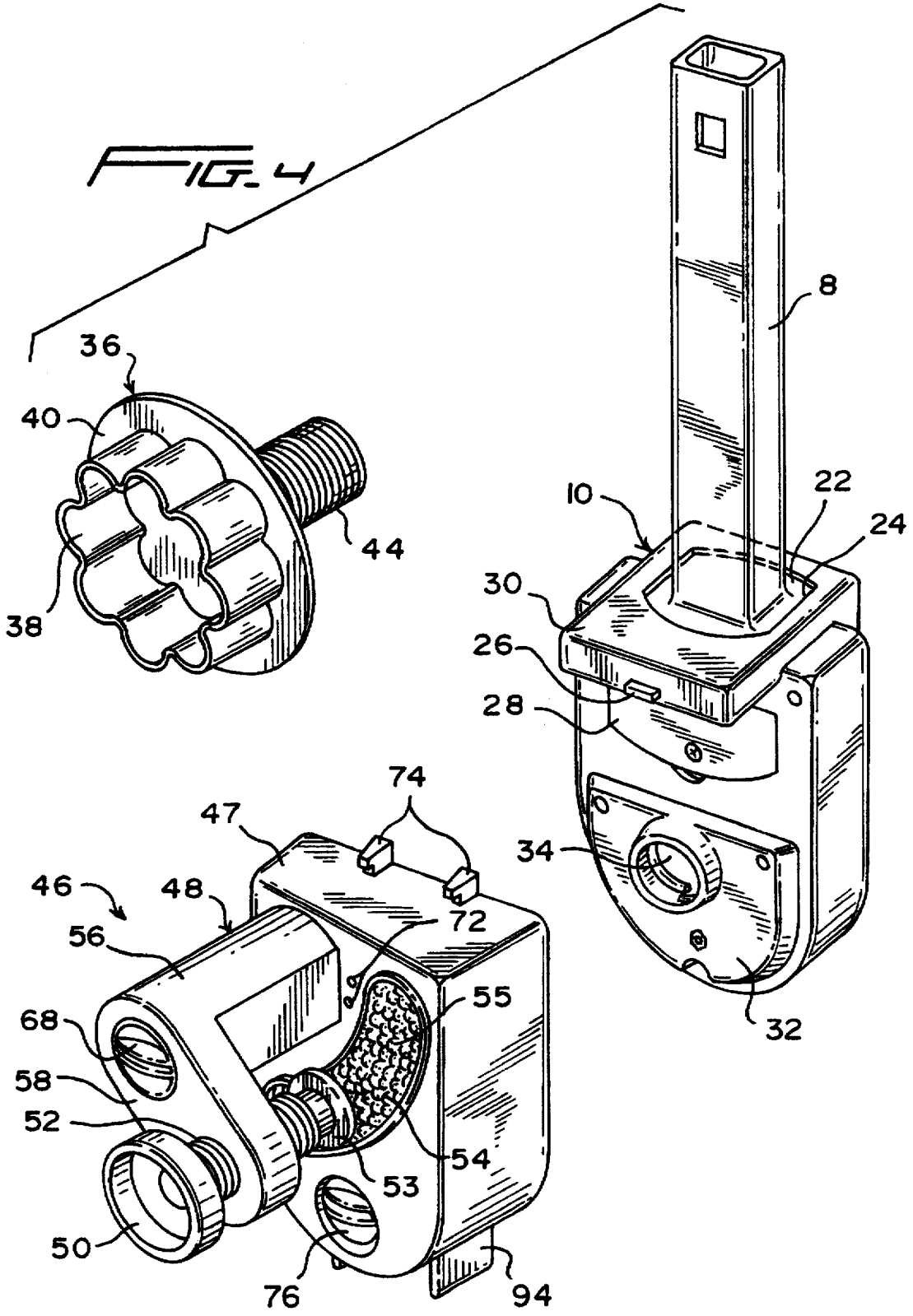
FIG. 4 is a perspective view showing the principal components of the invention including a main housing, a pressure knob which is removably attachable to the main housing, and a clamping assembly which is removably attachable to the main housing in lieu of the pressure knob.

As shown in FIG. 4, the lower end of the arm 8 has a flange 22 which is retained in a recess 24 in the top wall of the housing 10. A release button 26 on the housing is pressed to permit removal of the arm 8 from the housing.

The housing 10 includes a battery compartment, an electronic music box, a manually operated switch, and the electrical circuit which controls the operation of the music box and the motor. The battery compartment cover is shown at 28 in FIG. 4. The housing has a shoulder 30 which rests on the horizontal top rail of a conventional crib, a vertical clamping surface 32 which bears on the vertical rails of a crib, and an internally threaded hole 34 which receives the threaded shaft of a pressure knob 36 as will subsequently be described.

Figure 3:
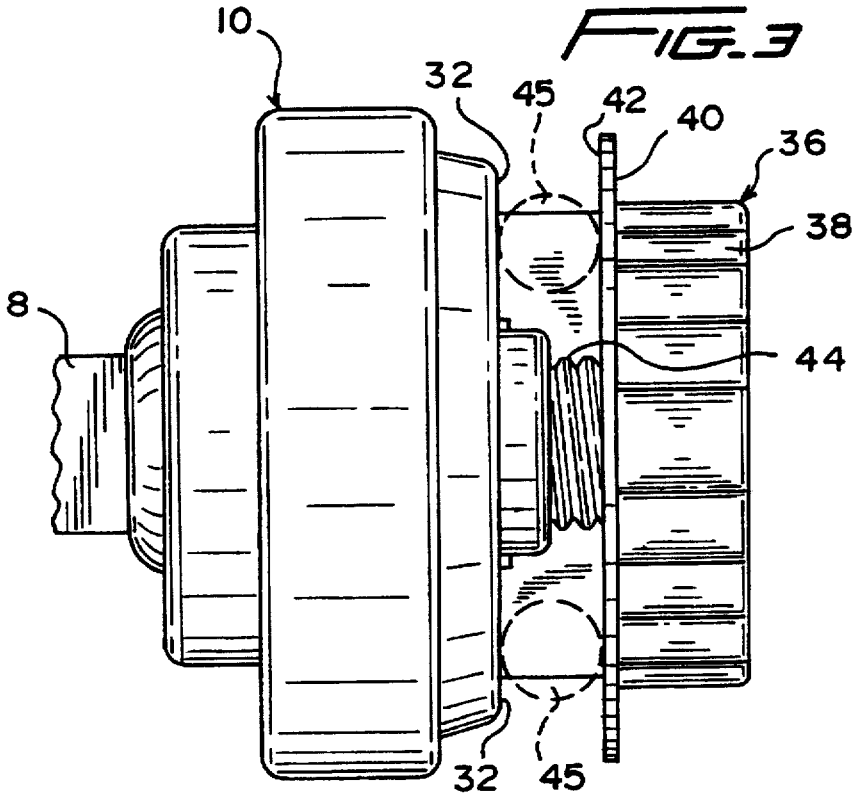
FIG. 3 is a bottom view showing an alternative arrangement of the assembly of FIG. 1, in which a pressure knob is used to mount the housing on the side of a conventional crib.

When the apparatus is mounted on a conventional crib, the pressure knob 36 securely retains the housing 10 in position in a known manner illustrated in FIG. 3. The pressure knob 36 includes a hand grip portion 38 and a flange portion 40 which has a pressure surface 42 facing toward the vertical clamping surface 32 of the housing 10 as shown in FIG. 3. A threaded shaft 44, preferably molded with and rotationally fixed to the pressure knob 36, is inserted between two vertical crib slats 45. As shown in FIG. 3, the shaft 44 is threaded into the hole 34 of the housing 10. The pressure knob 36 is rotated until the pressure surface 42 applies sufficient force on the crib slats 45 to clamp the device securely in position. When properly positioned, the shoulder 30 of the housing 10 will rest on the horizontal top rail of the crib side to deter any undesired lateral tilting of the housing.

The pressure knob 36 cannot be used with all infant furniture pieces. In some pieces, there are obstructions which prevent access to the opening 34, and, in other pieces, there are no slats which can be clamped between the clamping surfaces 32 and 42. In such situations, the pressure knob 36 is removed and a clamping assembly 46 is attached to the housing 10 where it occupies the space vacated by the pressure knob. The clamping assembly 46 is used to clamp the apparatus to the infant furniture piece.

The clamping assembly 46 has a hollow wedge-shaped base 47, a bracket 48 attached the base, and a knob 50 with a screw 52 which is threaded to the bracket 48. A pressure pad 53 on the screw faces toward a clamping surface 54 on the base 47. To prevent slippage, a circular piece of friction material is provided on the pressure pad 53, and an arcuate piece of friction material 55 is provided on the clamping surface of the base 47. As shown in FIG. 4, the clamping surface 54 lies at an acute horizontal angle relative to the clamping surface 32. The screw mechanism 52 moves the pressure pad along an axis which is perpendicular to the clamping surface 54.

The bracket 48 is a unitary piece which includes a post 56 and an arm 58. The post 56 is mounted on a shaft 60 which is molded integrally with the base 47. A bolt 62 extends through the shaft 60 to support a helical compression spring 64 and to receive a retainer nut 66 which is fixedly mounted in a manually turnable nut holder 68. As shown in FIG. 8, a nib 70 on the post 56 is located in a selected hole 72 formed in the housing to prevent rotary movement of the post 56 on the shaft 60. The retainer nut 66 is tightened to compress the spring 64 and to hold the nib 70 in the selected hole 72.

As shown in FIG. 7, the base 47 of the clamping assembly 46 is removably attached to the housing 10 by a pair of hooks 74 and a retainer screw 76. The base 47 is placed at an inclined position shown in broken lines in FIG. 7, the hooks 74 are inserted into openings 78 formed at the inside corner under the shoulder 30 of the housing 10, and the base 47 is moved to the upright position shown in solid lines in FIG. 7 so that the hooks engage the lower internal surface of the shoulder 30 of the housing. The screw 76 is then threaded into a nut 80 in the housing to retain the clamping assembly 46 on the housing 10.

Figure 5:
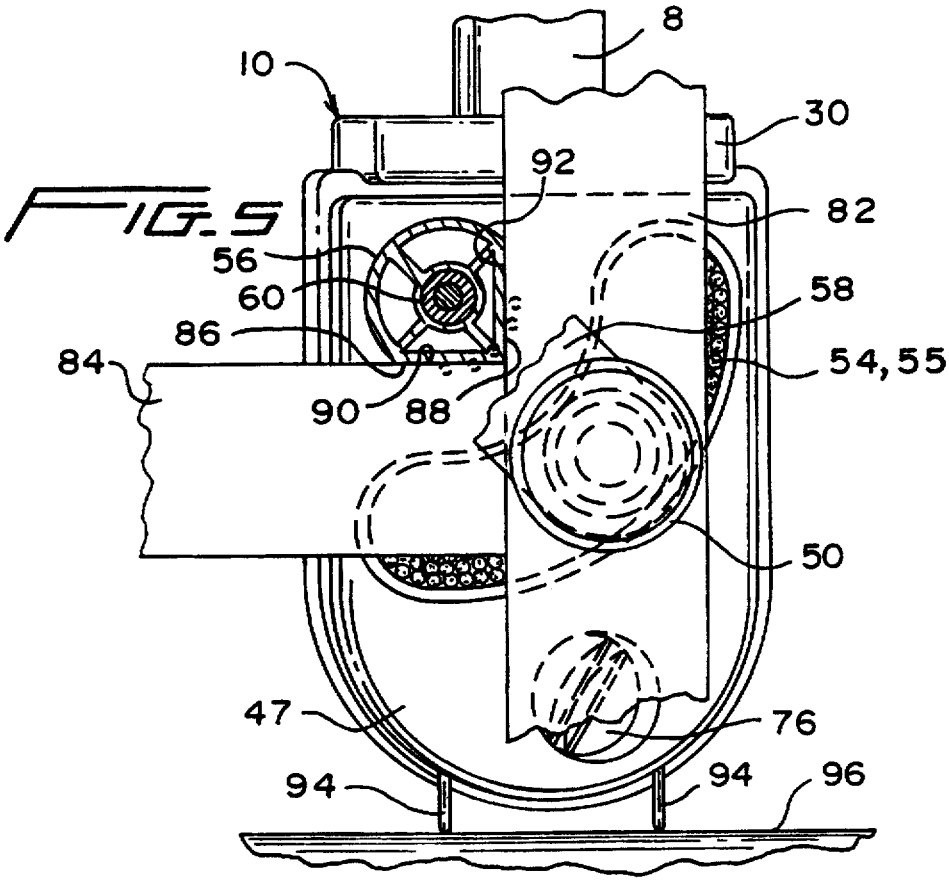
FIG. 5 is a front elevation view, partially broken away, showing the attachment of the mobile assembly to the corner structure of a travel bed.

FIG. 5 shows the use of the clamping assembly on a travel bed which has a corner post 82 and a top rail 84. The screw 52 is tightened so that the pressure pad 53 will bear forcibly against the corner post 82. Thus, the corner post 82 is clamped securely between the pressure pad 53 and the arcuate pad 55 of friction material on the clamping surface 54 of the base 47. To stabilize the housing, the post 56 has two flat surfaces 86 and 88 which, when possible, are used to engage two straight surfaces of the furniture piece. As shown in FIG. 5, the flat horizontal surface 86 of the post 56 rests on the straight upper surface 90 of the top rail 84, and the flat vertical surface 88 of the post 56 abuts the straight vertical side 92 of the corner post 82 of a travel bed.

For most situations where the clamping assembly 46 is used, the arm 58 will be at a forty-five degree inclination as shown in FIG. 5 so that the pressure pad 53 is horizontally and vertically offset from the post 56. Some infant furniture pieces, however, require that the pressure pad 53 be at a different position. Accordingly, the lateral position of the pressure pad 53 is adjustable. In the preferred embodiment, this is achieved by loosening the post-retaining nut 66 until the spring 64 lifts the nib 70 from the hole 72, rotating the post 56 on the shaft 60 until the nib is aligned with another hole 72, and then tightening the nut 66 at the new bracket orientation. Broken lines in FIG. 6 show five available inclinations of the arm. The pad 55 of friction material on the base 47 of the clamping assembly is arcuate and concentric with the axis of the post 56 so that, at each of the five available positions, the pressure pad 53 will be aligned with part of the arcuate pad 55 of friction material.

Figure 2:
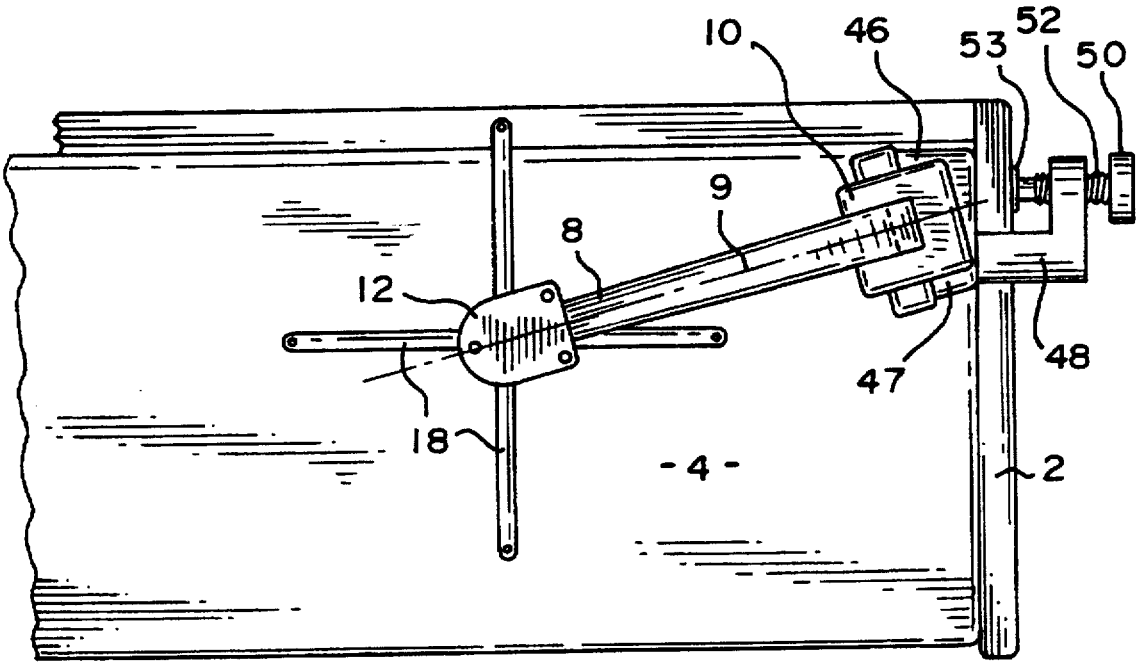
FIG. 2 is a plan view of the installation shown in FIG. 1.

On a conventional crib where the apparatus is attached as shown in FIG. 3, the housing can be mounted anywhere along the side of the crib to place the mobile at a suitable position. However, on furniture pieces where the clamping assembly 46 is used, it is often necessary to mount the housing 10 and clamping assembly 46 at or near a corner of the furniture piece. This imposes some limitations on placement of the mobile. If, on a travel bed, the housing 10 were mounted at a corner and oriented parallel to the side of the bed, the motor housing 12 would be located directly over the end of the travel bed, not over the area where the infant lies. To avert this undesirable situation, the base 47 of the clamping assembly 46 is wedge-shaped. This skews the housing so that, as shown in FIG. 2, its surface 32 is at an acute horizontal angle $\alpha$ relative to the clamping surface 54 of the clamping assembly 46. This places the center of the mobile over an area where the infant lies. The geometrical aspects of this feature are shown in FIG. 2, where it can be seen that the arm 8 lies in a vertical plane 9. This is perpendicular to and intersects the vertical clamping surface 32 shown in FIGS. 3 and 4. The eye 16 which is the suspension point of the mobile lies in the vertical plane 9. The plane 9 is skewed at acute horizontal angles relative to the clamping surface 32 and relative to the axis of the clamping screw 52.

There are some changing tables and other furniture pieces in which neither of the post surfaces 86 and 88 can be positioned against horizontal or vertical surfaces of the furniture piece as shown in FIG. 5. Some of the these pieces, however, have a horizontal surface which is located beneath the housing. To stabilize the apparatus in such installations, the base 47 of the clamping assembly 46 is provided with a pair of feet 94 which are best shown in FIG. 5. These feet are positioned where they will rest securely on a horizontal surface, such as the surface 96 shown in FIG. 5. This will deter lateral tilting of the clamping assembly 46 and housing 10. As a practical matter, most furniture pieces will have either the surfaces 90, 92 or the surface 96 for stabilizing the apparatus. Few furniture pieces, if any, will have all of these surfaces.

From the foregoing description, persons familiar with the field of the invention will realize that the present invention offers a versatile and effective way of attaching an infant mobile to cribs, changing tables, travel beds, and other furniture pieces. The invention also may be used for attaching activity boxes and other toys to such furniture pieces. Although the screw 52 is the preferred mechanism for moving the pressure pad 53 toward the surface 54, other mechanisms such as cams, levers and compression springs may be used.

In view of the many possible variations of the invention, it is emphasized that the invention is not limited to the embodiments disclosed and described in the specification. It may take many forms which fall within the spirit of the following claims.

I claim:

1. A toy assembly which is mountable on a variety of infant furniture pieces including cribs which have a plurality of vertical slats, said toy assembly comprising, a housing which supports the toy and has a first clamping surface thereon which is vertical;

an infant's toy attached to and supported by said housing;

a clamping assembly which has opposed clamping surfaces and is removably mountable on the housing, said toy being connected by said housing to said clamping assembly;

said clamping assembly including a base, a mechanism which is mounted on said base, and a pressure pad which is one of said opposed clamping surfaces and is operatively connected to and moved by said mechanism; said mechanism being operable to move said pressure pad into frictional engagement with part of an infant furniture piece to clamp said clamping assembly to an infant furniture piece;

means for simultaneously engaging a plurality of vertical slats of an infant furniture piece, said means being a pressure knob which is mountable on said housing in lieu of said clamping assembly, said pressure knob having a pressure surface which faces toward the first clamping surface of said housing and is wide enough to engage simultaneously a plurality of slats, a threaded shaft removably connecting said pressure knob to said housing and being operable to pull the first clamping surface against said slats, said threaded shaft being positionable between slats of an infant furniture piece where said pressure surface of the pressure knob bears against said slats.

2. An infant toy assembly according to claim 1 wherein the position of the pressure pad is laterally adjustable on said clamping assembly.

3. An infant toy assembly according to claim 1 wherein the mechanism includes a screw which is rotatable to move said pressure pad; said clamping assembly including a second clamping surface which is vertical, said pressure pad facing toward said second clamping surface so that part of an infant furniture piece can be clamped between said pressure pad and said second clamping surface.

4. An infant toy assembly according to claim 3 wherein the second clamping surface of the clamping assembly has a covering of friction material which resists lateral slippage of said toy assembly relative to part of an infant furniture piece which is clamped thereagainst.

5. An infant toy assembly according to claim 4 wherein the covering of friction material has an arcuate shape.

6. An infant toy assembly according to claim 1 including a support arm which supports the mechanism, said support arm being movable to different inclinations to provide lateral adjustments of the pressure pad.

7. An infant toy assembly according to claim 6 including means for locking the support arm at a selected inclination.

8. An infant toy assembly according to claim 1 wherein the mechanism is mounted on a bracket which includes a post, said post having a flat surface for engaging a straight surface of an infant furniture piece.

9. An infant toy assembly according to claim 1 wherein the mechanism is mounted on a bracket which includes a post, said post having two flat surfaces for engaging two straight surfaces of an infant furniture piece to which the toy assembly is attached.

10. An infant toy assembly according to claim 1 wherein the base has feet for engaging a horizontal surface of an infant furniture piece to stabilize said toy assembly against lateral tilting.

11. An infant toy assembly according to claim 1 wherein the toy is a mobile provided with figures which are observable by an infant lying on the furniture piece.

12. An infant toy assembly according to claim 1, wherein said clamping assembly includes a second clamping surface which is vertical and is one of said opposed clamping surfaces, said pressure pad facing toward said second clamping surface so that part of an infant furniture piece can be clamped between said pressure pad and said second clamping surface, said first clamping surface lying at an acute horizontal angle relative to said second clamping surface.

13. A toy assembly which is mountable on a variety of infant furniture pieces, said toy assembly comprising, a housing;

a toy attached to and supported by said housing;

a clamping assembly for supporting the housing, said clamping assembly including a clamping surface, a mechanism and a pressure pad which is operatively connected to and moved by said mechanism along an axis toward and away from said clamping surface, said clamping surface being perpendicular to said axis;

said clamping surface lying at an acute horizontal angle relative to said housing so that said housing is skewed relative to the clamping surface of said clamping assembly;

said clamping surface being larger than said pressure pad so that said pressure pad faces only a portion of said clamping surface, said mechanism being operable to move said pressure pad into frictional engagement with part of an infant furniture piece to clamp said toy assembly to an infant furniture piece; a support arm which supports the mechanism, said support arm being movable relative the clamping surface to position the support arm at different inclinations at which the pressure pad faces different portions of said clamping surface and occupies different lateral positions relative to the clamping surface.

14. An infant toy assembly according to claim 13 wherein the toy is a mobile provided with figures which are observable by an infant lying on the furniture piece.

15. An infant toy assembly according to claim 14 including means for locking the support arm at a selected inclination.

16. A toy assembly which is mountable on a variety of infant furniture pieces, said toy assembly comprising, a housing;

a toy attached to and supported by said housing;

a clamping assembly for supporting the housing, said clamping assembly including a mechanism and a pressure pad which is operatively connected to and moved by said mechanism; said mechanism being operable to move said pressure pad along one axis into frictional engagement with part of an infant furniture piece to clamp said toy assembly to an infant furniture piece; a bracket which supports the mechanism, said bracket including a post which is parallel to said axis and an arm which is supported by the post, said arm being inclined from vertical and horizontal, said post having an axis which is stationary with respect to said housing and having two flat surfaces which lie in vertical and horizontal planes which are parallel to said axis for engaging two straight surfaces of an infant furniture piece to which the toy assembly is attached.

17. An infant toy assembly according to claim 16 wherein the toy is a mobile provided with figures which are observable by an infant lying on the furniture piece.

18. A mobile assembly which is mountable on a variety of infant furniture pieces, said mobile assembly comprising, a housing having a vertical surface;

a mobile attached to and supported by said housing, said mobile having figures which are observable by an infant lying on said furniture piece, said mobile having a suspension point which is higher than and is laterally spaced from said housing, said suspension point lying in a vertical plane which is perpendicular to and intersects said vertical surface of the housing;

a clamping assembly mounted on the housing for clamping the housing onto a furniture piece, said clamping assembly including a clamping surface, a mechanism, and a pressure pad which is operatively connected to and moved by said mechanism; said mechanism being operable to move said pressure pad along an axis toward said clamping surface and into frictional engagement with part of an infant furniture piece to clamp said mobile assembly to an infant furniture piece; said vertical surface of said housing being skewed at an acute horizontal angle relative to said clamping surface and being skewed at an acute horizontal angle relative to said axis so that, when said housing is mounted in a corner of the furniture piece, the mobile will be over an area occupied by an infant.

19. A toy assembly which is mountable on a variety of infant furniture pieces which have vertical slats, said toy assembly comprising, a housing having a first clamping surface which is vertical;

a toy attached to and supported by said housing;

a clamping assembly including a base which is removably mountable on the housing, a mechanism which is mounted on said base, and a pressure pad which is operatively connected to and moved by said mechanism; said mechanism being operable to move said pressure pad into frictional engagement with part of an infant furniture piece to clamp said clamping assembly to an infant furniture piece;

means for engaging simultaneously a plurality of vertical slats of an infant furniture piece, said means being a pressure knob which is mountable on said housing in lieu of said clamping assembly, said pressure knob having a pressure surface which faces toward the first clamping surface of said housing, a threaded shaft removably connecting said pressure knob to said housing, said threaded shaft being positionable between slats of an infant furniture piece where said pressure surface of the pressure knob bears against said slats;

said clamping assembly including a second clamping surface which is vertical, said pressure pad facing toward said second clamping surface so that part of an infant furniture piece can be clamped between said pressure pad and said second clamping surface, said first clamping surface being at an acute horizontal angle relative to said second clamping surface.

20. A toy assembly which is mountable on a variety of infant furniture pieces including cribs which have a plurality of vertical slats, said toy assembly comprising, a housing which supports the toy and has a first clamping surface thereon which is vertical;

an infant's toy attached to and supported by said housing;

means for simultaneously engaging a plurality of vertical slats of an infant's crib, said means being a pressure knob which is removably mountable on said housing, said pressure knob having a pressure surface which faces toward the first clamping surface of said housing and is wide enough to engage simultaneously a plurality of slats, a threaded shaft removably connecting said pressure knob to said housing and being operable to move the first clamping surface against said slats in response to rotation of said pressure knob, said threaded shaft being positionable between slats of an infant furniture piece where said pressure surface of the pressure knob bears against said slats;

a clamping assembly which is removably mountable on the housing when the pressure knob has been removed from the housing, said clamping assembly lying at a position occupied by the pressure knob when the pressure knob was mounted on the housing;

said clamping assembly including an arm, a mechanism which is mounted on said arm, and a pressure pad which is operatively connected to and moved by said mechanism; said mechanism being operable to move said pressure pad into frictional engagement with part of an infant furniture piece to clamp said clamping assembly to an infant furniture piece.

21. A toy assembly according to claim 1 wherein said first clamping surface is parallel to the pressure surface of the pressure knob when the pressure knob is mounted on the housing; one of said clamping surfaces of said clamping assembly being a second clamping surface for engaging a vertical surface of an infant furniture piece, said second clamping surface overlying and being spaced from said first clamping surface when the clamping assembly is attached to said housing, said second clamping surface lying at an acute horizontal angle relative to said first clamping surface, said pressure pad being movable in a direction which is perpendicular to said second clamping surface.

22. A toy assembly according to claim 1 wherein said pressure knob, when mounted on said housing, occupies a space which is adjacent to said housing, said pressure knob being removable from said housing to vacate said space, said clamping assembly when mounted on said housing being located in the space vacated by the pressure knob.

23. A toy assembly according to claim 13 wherein said housing has a first clamping surface for engaging a vertical surface of an infant furniture piece, a pressure knob which is removably mounted on the housing and has a pressure surface which faces said first clamping surface, said first clamping surface being vertical and parallel to the pressure surface of the pressure knob when the pressure knob is mounted on the housing; said clamping surface of the clamping assembly overlying and being spaced from said first clamping surface when the clamping assembly is attached to said housing, said clamping surface of the clamping assembly lying at an acute horizontal angle relative to said first clamping surface, said pressure pad being movable in a direction which is perpendicular to said clamping surface of the clamping assembly.

24. A toy assembly according to claim 13 having a pressure knob which is removably mounted on the housing and has a pressure surface which faces said housing, said pressure knob, when mounted on said housing, occupying a space which is adjacent to said housing, said pressure knob being removable from said housing to vacate said space, said clamping assembly when mounted on said housing being located in the space vacated by the pressure knob.

25. A toy assembly according to claim 16 wherein said housing has a first clamping surface for engaging a vertical surface of an infant furniture piece, a pressure knob which is removably mounted on the housing and has a pressure surface which faces said first clamping surface, said first clamping surface being vertical and parallel to the pressure surface of the pressure knob when the pressure knob is mounted on the housing; said clamping assembly including a second clamping surface for engaging a vertical surface of an infant furniture piece, said second clamping surface overlying and being spaced from said first clamping surface when the clamping assembly is attached to said housing, said second clamping surface lying at an acute horizontal angle relative to said first clamping surface, said pressure pad being movable in a direction which is perpendicular to said second clamping surface.

26. A toy assembly according to claim 16 having a pressure knob which is removably mounted on the housing and has a pressure surface which faces said housing, said pressure knob, when mounted on said housing, occupying a space which is adjacent to said housing, said pressure knob being removable from said housing to vacate said space, said clamping assembly when mounted on said housing being located in the space vacated by the pressure knob.

27. A mobile assembly according to claim 18 wherein said housing has a first clamping surface for engaging a vertical surface of an infant furniture piece, a pressure knob which is removably mounted on the housing and has a pressure surface which faces said first clamping surface, said first clamping surface being vertical and parallel to the pressure surface of the pressure knob when the pressure knob is mounted on the housing; said clamping surface of the clamping assembly overlying and being spaced from said first clamping surface when the clamping assembly is attached to said housing, said clamping surface of the clamping assembly lying at an acute horizontal angle relative to said first clamping surface, said pressure pad being movable in a direction which is perpendicular to said clamping surface of the clamping assembly.

28. A mobile assembly according to claim 18 having a pressure knob which is removably mounted on the housing and has a pressure surface which faces said housing, said pressure knob, when mounted on said housing, occupying a space which is adjacent to said housing, said pressure knob being removable from said housing to vacate said space, said clamping assembly when mounted on said housing being located in the space vacated by the pressure knob.

* * * * *